US011607578B2

(12) United States Patent
Listro

(10) Patent No.: US 11,607,578 B2
(45) Date of Patent: Mar. 21, 2023

(54) MULTI-FUNCTIONAL DOORWAY EXERCISE DEVICE

(71) Applicant: David Joseph Listro, Clinton, CT (US)

(72) Inventor: David Joseph Listro, Clinton, CT (US)

( * ) Notice: Subject to any disclaimer, the term of this patent is extended or adjusted under 35 U.S.C. 154(b) by 63 days.

(21) Appl. No.: 17/244,849

(22) Filed: Apr. 29, 2021

(65) Prior Publication Data

US 2021/0339075 A1 Nov. 4, 2021

Related U.S. Application Data

(60) Provisional application No. 63/017,379, filed on Apr. 29, 2020.

(51) Int. Cl.

| | |
|---|---|
| ***A63B 21/16*** | (2006.01) |
| ***A63B 23/12*** | (2006.01) |
| ***A63B 1/00*** | (2006.01) |

(52) U.S. Cl.

CPC ..... *A63B 21/1627* (2013.01); *A63B 1/00* (2013.01); *A63B 21/1636* (2013.01); *A63B 23/1218* (2013.01); *A63B 2225/09* (2013.01)

(58) Field of Classification Search

CPC ..... A63B 21/1627; A63B 21/1636; A63B 21/0442; A63B 21/0552; A63B 21/1645; A63B 21/068; A63B 21/1654; A63B 1/00; A63B 23/1218; A63B 23/1236; A63B 2225/09; A63B 21/1618–1663; A63B 23/1209–1227; F16L 37/2445; F16L 15/00; F16L 15/08

USPC ..... 285/32, 298–303

See application file for complete search history.

(56) References Cited

U.S. PATENT DOCUMENTS

| | | | | |
|---|---|---|---|---|
| 6,447,021 | B1 * | 9/2002 | Haynes | E21B 43/10 285/302 |
| 7,566,292 | B1 * | 7/2009 | Hauser | A63B 23/12 482/40 |
| 7,621,847 | B2 | 11/2009 | Lamle et al. | |
| 9,114,273 | B2 * | 8/2015 | Kehoe | A63B 21/068 |
| 2012/0046150 | A1 * | 2/2012 | Stacey | A63B 23/0216 482/131 |

(Continued)

OTHER PUBLICATIONS

Doorway Fitness Tower, https://www.fitnaturalmia.com/pages/products.

(Continued)

*Primary Examiner* — Loan B Jimenez
*Assistant Examiner* — Kathleen M Fisk

(57) ABSTRACT

A multi-functional doorway exercise device is an apparatus that safely and securely attaches to a door frame. The apparatus includes a stabilizing bar, a main pullup bar, a first support bar, a second support bar, a left bracket assembly, a right bracket assembly, a left handlebar, and a right handlebar. The stabilizing bar extends across the width of a door frame and locks into the door frame. The main pullup bar, the left handlebar, and the right handlebar allows a user to grasp onto the present invention while performing various exercises with different grip positions. The left bracket assembly and the right bracket assembly attaches the stabilizing bar onto and along both sides of the door frame. The first support bar and the second support bar connect the main pullup bar with the stabilizing bar and allows the main pullup bar to rotate about the stabilizing bar.

12 Claims, 6 Drawing Sheets

(56) References Cited

U.S. PATENT DOCUMENTS

| | | | | |
|---|---|---|---|---|
| 2012/0129658 | A1* | 5/2012 | Hunt | A63B 23/1218 482/38 |
| 2013/0244836 | A1* | 9/2013 | Maughan | A63B 23/1218 482/40 |
| 2014/0323275 | A1* | 10/2014 | Moses, II | A63B 21/4043 482/40 |
| 2015/0148197 | A1 | 5/2015 | Lentz et al. | |
| 2015/0316180 | A1* | 11/2015 | Marchand | F16L 15/08 285/390 |
| 2018/0085622 | A1* | 3/2018 | Ivan | A63B 21/1636 |

OTHER PUBLICATIONS

Over the Door Trainer Pull-Up Bar Gym and Dip Station, https://www.titan.fitness/strength/strength-accessories/other/over-the-door-trainer-pull-up-bar-gym-and-dip-station/400503.html.

The Original Patented Triple Door Gym, https://www.amazon.com/SHAMROCK-TRIPLE-GYM-Suspension-Supports/dp/B0865HW118.

* cited by examiner

MULTI-FUNCTIONAL DOORWAY EXERCISE DEVICE

The current application claims a priority to the U.S. Provisional Patent application Ser. No. 63/017,379 filed on Apr. 29, 2020.

FIELD OF THE INVENTION

The present invention generally relates to exercise equipment. More specifically, the present invention is a multi-functional doorway exercise device.

BACKGROUND OF THE INVENTION

The present invention provides the means for a complete exercise workout using a singular device that mounts in a standard doorway without the use of any permanently attached hardware. The present invention is completely portable and requires no attachments or removable parts. Depending on the position of the present invention along the height of the door frame, the present invention allows a user to accomplish the following: incline pushups, decline pushups, reverse pushups, dips, pull ups, and chin ups. The user may choose to attach tension bands for a larger variety of exercises in order to tone legs, biceps curls, tricep pull downs, chest, and shoulder work. The present invention is useful for able-bodied persons of any age interested in toning and strengthening various muscle groups. The present invention offers the ability to complete a full body workout with a single unit portable device without the use of any fixed doorway attaching hardware. The present invention can be positioned into a standard width door casing and 32-inch door frame along any height of the door frame depending on the exercise preference of the user.

DETAILED DESCRIPTIONS OF THE INVENTION

All illustrations of the drawings are for the purpose of describing selected versions of the present invention and are not intended to limit the scope of the present invention.

The present invention is a multi-functional doorway exercise device. The present invention may be mounted on door frames of various widths and the position of the present invention is not dependent on door casing of the door frame.

Figure 1:
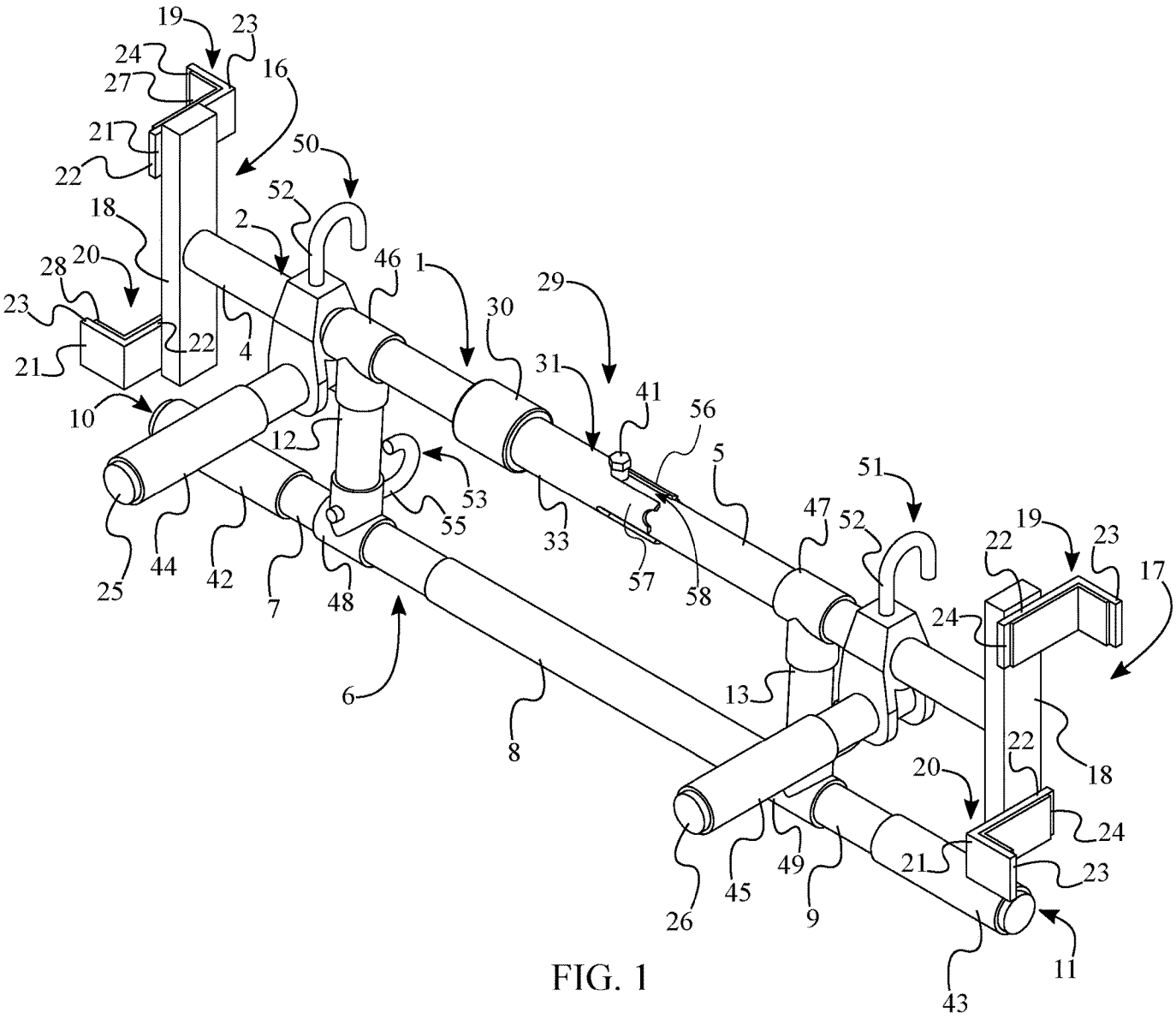
FIG. 1 is a perspective view of the present invention with a main pullup bar rotated beneath a stabilizing bar.
Figure 2:
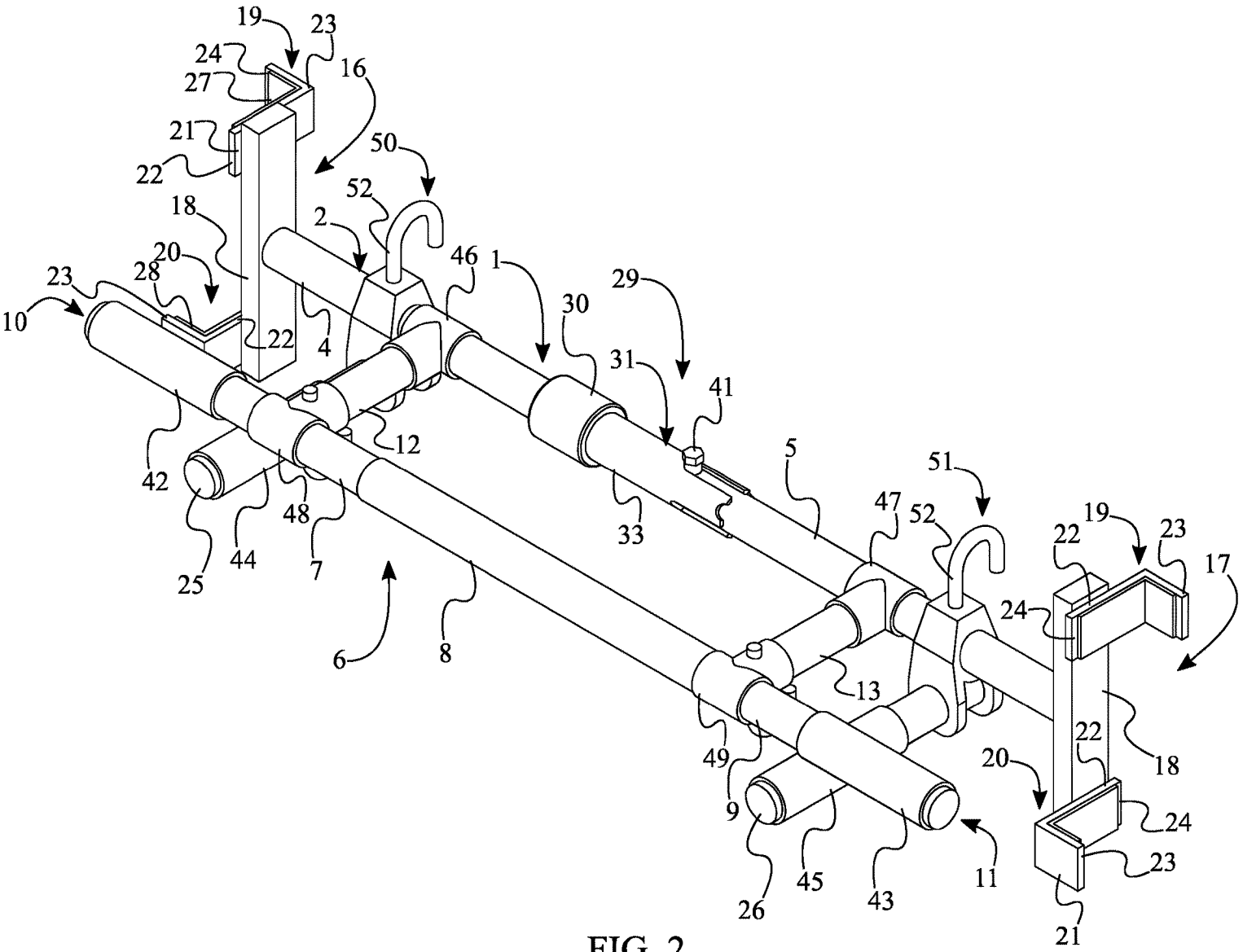
FIG. 2 is a perspective view of the present invention with the main pullup bar rotated around the stabilizing bar, wherein the main pullup bar rest on a left handlebar and a right handlebar.

Moreover, the present invention may be positioned at any height along a door frame to accommodate the height of the user and a variety of types of exercises. The present invention is inserted into a door frame, moves and slides vertically inside the door frame to facilitate a complete range of exercises involving lower body exercises, elevated pushups, decline pushups, sit-ups, leg work, curls (with the user of tension bands). More specifically, the present invention adjusts anywhere from a few inches above the floor to a few inches from the top of the door frame. The present invention is self-contained and requires no additional attachments and has no removable parts. More specifically, the present invention has no additional parts that need to be removed and put back together for use. Consequently, the present invention is easily inserted, removed, stowed, and transported as a single unit. In addition, the present invention may remain attached with the door frame while not in use. The present invention may be positioned at the top of the door frame, allow fill access through the door frame. The present invention therefore provides the user with multiple safe and stable configurations so that the user may perform multiple exercises that are not typically available with standard at-home exercise devices. In order to effectively support the body weight of the user along a door frame, the present invention may comprise a stabilizing bar 1, a main pullup bar 6, a first support bar 12, a second support bar 13, a left bracket assembly 16, a right bracket assembly 17, a left handlebar 25, and a right handlebar 26, seen in FIG. 1 and FIG. 2. The stabilizing bar 1 extends across the width of a door frame and is positioned within the door frame. The stabilizing bar 1 applies an outward force or horizontal pressure is applied against the door frame in order to secure the desired position along the height of the door frame. The main pullup bar 6 supports the weight of the user as the user performs a variety of exercises. The first support bar 12 and the second support bar 13 connect the main pullup bar 6 with the stabilizing bar 1. The left bracket assembly 16 and the right bracket assembly 17 connects the stabilizing bar 1 along either side of the door frame. The left bracket assembly 16 and the right bracket assembly 17 grasp the door frame and prevent the stabilizing bar 1 from slipping past the door frame. The left handlebar 25 and the right handlebar 26 allow the user to use different grip positions with the present invention for multiple exercises such as a pullup or a dip. Pressure is exerted when the weight of the user is applied to the left handlebar 16 and the right handlebar 17, as well as the main pullup bar 6, in turn creating a counterclockwise force about the stabilizing bar 1, which in turn applies the counterclockwise force with the left bracket assembly 16 and the right bracket assembly 17.

Figure 3:
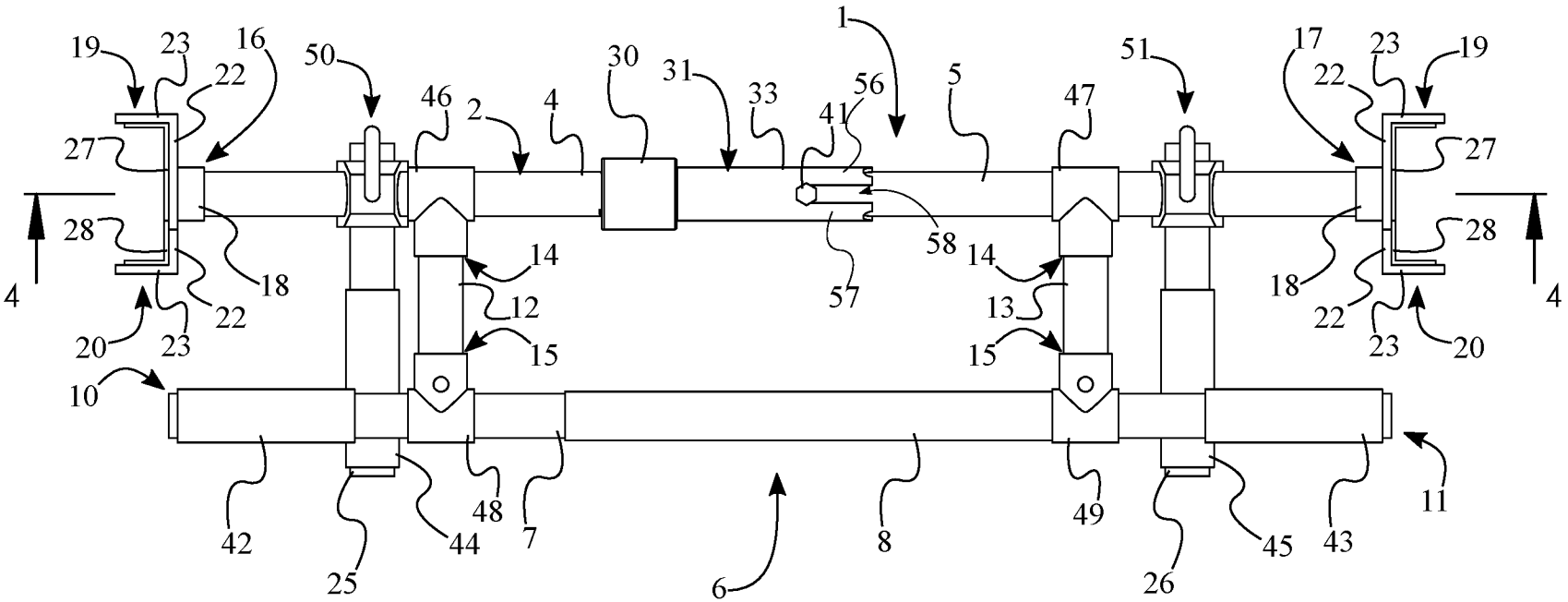
FIG. 3 is a top side view of the present invention with the main pullup bar rotated around the stabilizing bar, wherein the main pullup bar rests on a left handlebar and a right handlebar.
Figure 5:
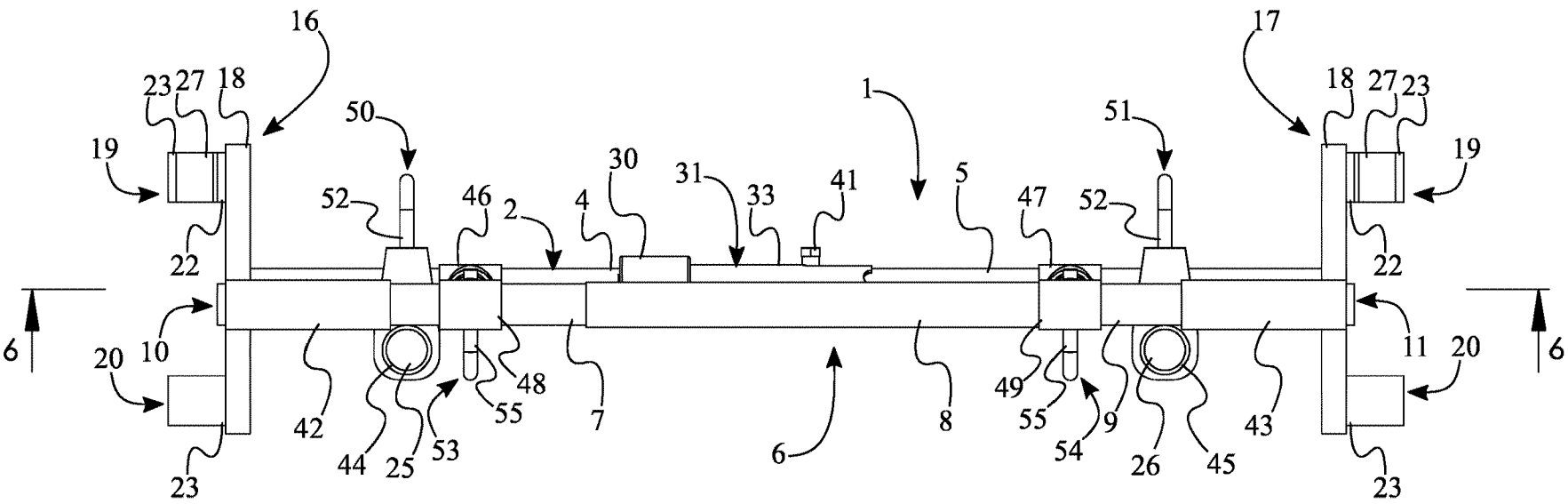
FIG. 5 is a front side view of the present invention with the main pullup bar rotated around the stabilizing bar, wherein the main pullup bar rests on a left handlebar and a right handlebar.

The overall configuration of the aforementioned components allows the present invention to accommodate various sized door frames and allows the present invention to be positioned along any height along a door frame. In order to mount the present invention within a door frame, the left bracket assembly 16 is terminally connected with the stabilizing bar 1. Conversely, the right bracket assembly 17 is terminally connected with the stabilizing bar 1, opposite the left bracket assembly 16, seen in FIG. 3 and FIG. 5. This arrangement allows the stabilizing bar 1 to traverse across the door frame. The main pullup bar 6 is positioned parallel and offset from the stabilizing bar 1 so that the user may freely and safely grasp onto the present invention. In order to provide the user with ample space between the stabilizing bar 1 and the main pull up bar, the first support bar 12 and the second support bar 13 are positioned in between the stabilizing bar 1 and the main pullup bar 6. More specifically, the first support bar 12 is positioned offset with the left bracket assembly 16. Likewise, the second support bar 13 is positioned offset with the right bracket assembly 17. The first support bar 12 and the second support bar 13 are positioned offset from each other, effectively balancing the main pullup bar 6 with the stabilizing bar 1. The user may perform even more types of exercises as the main pullup bar 6 is rotatably mounted about the stabilizing bar 1 by the first support bar 12 and the second support bar 13, such that the main pullup bar 6 may then rest upon the left handlebar 25 and the right handlebar 26, supporting a variety of other exercises such as various grip pullups, incline pushup, decline pushups, and so on, seen in FIG. 2, FIG. 3 and FIG. 5. Conversely, the main pullup bar 6 may be rotated under the stabilizing bar 1 in a vertical downward position, seen in FIG. 1. In this configuration, the main pullup bar 6 does not inhibit the grip and reach of a user with the left handlebar 25 and the right handlebar 26 while performing exercises such as dips and pullups. In order for the left handlebar 25 and the right handlebar 26 to be balanced with stabilizing bar 1, the left handlebar 25 is positioned in between the left bracket assembly 16 and the first support bar 12. Likewise, the right handlebar 26 is positioned in between the right bracket assembly 17 and the second support bar 13. The left handlebar 25 and the right handlebar 26 are fixed perpendicular with the stabilizing bar 1, allowing the user to perform exercises with different grip positions with the present invention. In the preferred embodiment of the present invention, the left handlebar 25 and the right handlebar 26 are fixed with the stabilizing bar 1 with crossover connectors. It is understood that alternate embodiments may utilize other connectors. More specifically, the left handlebar 25 and the right handlebar 26 are positioned parallel with each other, reinforcing proper form for the user throughout each exercise.

In order for the left bracket assembly 16 and the right bracket assembly 17 to securely grasp a door frame, the left bracket assembly 16 and the right bracket assembly 17 may each comprise a connecting bar 18, a first L-shaped bracket 19, and a second L-shaped bracket 20, seen in FIG. 1, FIG. 2, FIG. 3, FIG. 4, FIG. 5, and FIG. 6. The connecting bar 18 presses against a vertical length of the door frame and attaches the stabilizing bar 1 with both the first L-shaped bracket 19 and the second L-shaped bracket 20. Together, the first L-shaped bracket 19 and the second L-shaped bracket 20 grasp the door frame and counteract the force of the weight of the user. The left bracket assembly 16 and the right bracket assembly 17 extends across the corresponding sides of the door frame as the connecting bar 18 is positioned perpendicular with the stabilizing bar 1. Moreover, the stabilizing bar 1 is fixed adjacent with the connecting bar 18. An outer surface 21 of the first L-shaped bracket 19 and an outer surface 21 of the second L-shaped bracket 20 are positioned adjacent with the connecting bar 18, opposite the stabilizing bar 1, thereby positioning both the first L-shaped bracket 19 and the second L-shaped bracket 20 around the door frame. More specifically, the first L-shaped bracket 19 is positioned opposite the second L-shaped bracket 20 along the connecting bar 18, preventing the connecting bar 18 from slipping past the edge of the door frame.

In order to effectively press on the door frame, the first L-shaped bracket 19 and the second L-shaped bracket 20 may each comprise a proximal leg 22 and a distal leg 23, also seen in FIG. 1, FIG. 2, FIG. 3, FIG. 4, FIG. 5, and FIG. 6. The proximal leg 22 presses across an inner surface 24 of the door frame. The distal leg 23 presses against either a front surface or a rear surface of the door frame. The proximal leg 22 is positioned orthogonal to the connecting bar 18 and the stabilizing bar 1, thereby superimposing the first L-shaped bracket 19 and the second L-shaped bracket 20 across the curvature of the door frame. More specifically, the proximal leg 22 is laterally fixed with the connecting bar 18, and both the distal leg 23 of the first L-shaped bracket 19 and the distal leg 23 of the second L-shaped bracket 20 are oriented away from the connecting bar 18. This arrangement positions the front surface and the rear surface between the distal leg 23 of the first L-shaped bracket 19 and the distal leg 23 of the second L-shaped bracket 20.

In order to preserve the integrity of the door frame, the present invention may further comprise a first padded layer 27 and a second padded layer 28, also seen in FIG. 1, FIG. 2, FIG. 3, FIG. 4, FIG. 5, and FIG. 6. The first padded layer 27 cushions the door frame against the first L-shaped bracket 19. Similarly, the second padded layer 28 cushions the door frame against the second L-shaped bracket 20. The first padded layer 27 is fixed across an inner surface 24 of the first L-shaped bracket 19, protecting the door frame from the first L-shaped bracket 19. The second padded layer 28 is fixed across an inner surface 24 of the second L-shaped bracket 20, protecting the door frame from the second L-shaped bracket 20.

As the present invention is able to accommodate door frames of various widths with the stabilizing bar 1, the present invention may further comprise a locking mechanism 29 to lock a desired length for the stabilizing bar 1, seen in FIG. 1, FIG. 2, FIG. 3, FIG. 4, FIG. 5, and FIG. 6. In order for the stabilizing bar 1 to extend and shorten, the stabilizing bar 1 may comprise a left tube 2 and a right tube 5. Moreover, the left tube 2 may comprise an inner portion 3 and an outer portion 4. The inner portion 3 connects the left tube 2 within the right tube 5. The outer portion 4 connects the inner portion 3 with the left bracket assembly 16. The stabilizing bar 1 is defined with the right tube 5 and the left tube 2 as the right tube 5 is positioned adjacent with the left tube 2. The right tube 5 and the left tube 2 are continuously and freely connected with each other as the right bracket assembly 17 is terminally fixed with the right tube 5, opposite the left tube 2. In order for the length of the stabilizing bar 1 to be adjustable, the inner portion 3 is telescopically engaged into the right tube 5. More specifically, the outer portion 4 is terminally fixed with the inner portion 3, opposite to the right tube 5. Similar with the right tube 5, the left bracket assembly 16 is terminally fixed with the outer portion 4, opposite the inner portion 3. The stabilizing bar 1 remains within the door frame as the locking mechanism 29 is operatively integrated in between the left tube 2 and the right tube 5, wherein the locking mechanism 29 is used to adjust a total length between the left tube 2 and the right tube 5. Moreover, the total length between the left tube 2 and the right tube 5 traverses across the width of a door frame.

Figure 4:
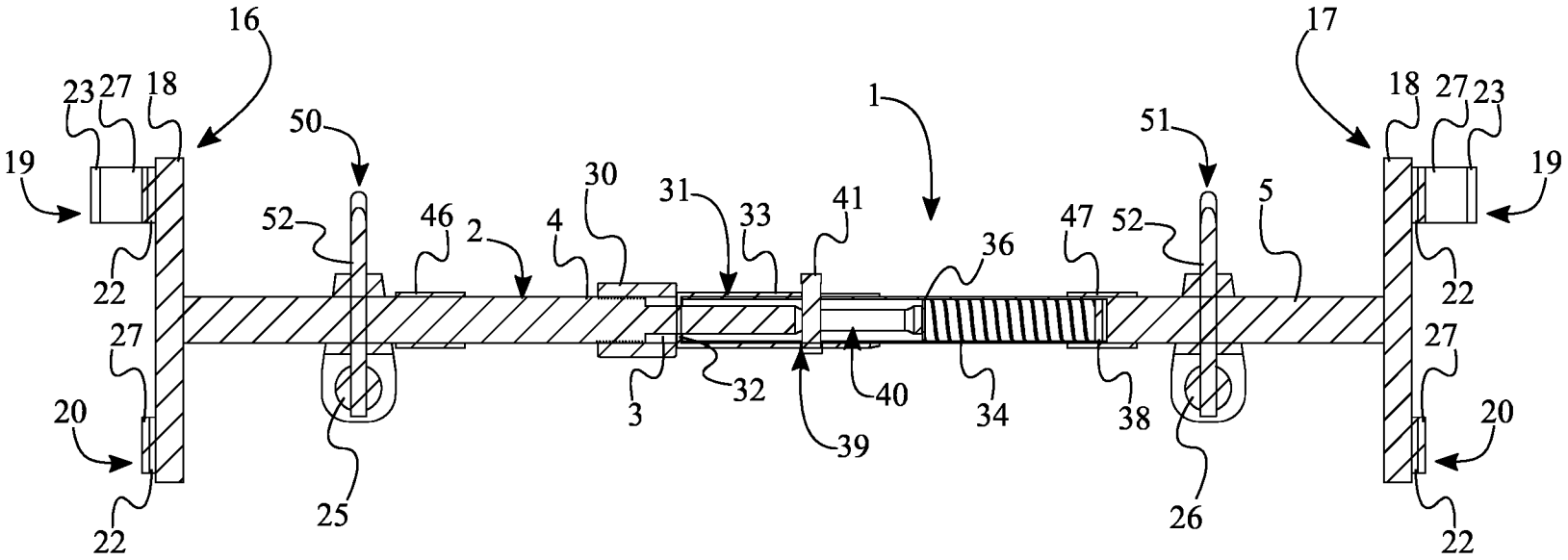
FIG. 4 is a cross-section view taken along line 4-4 in FIG. 3.
Figure 6:
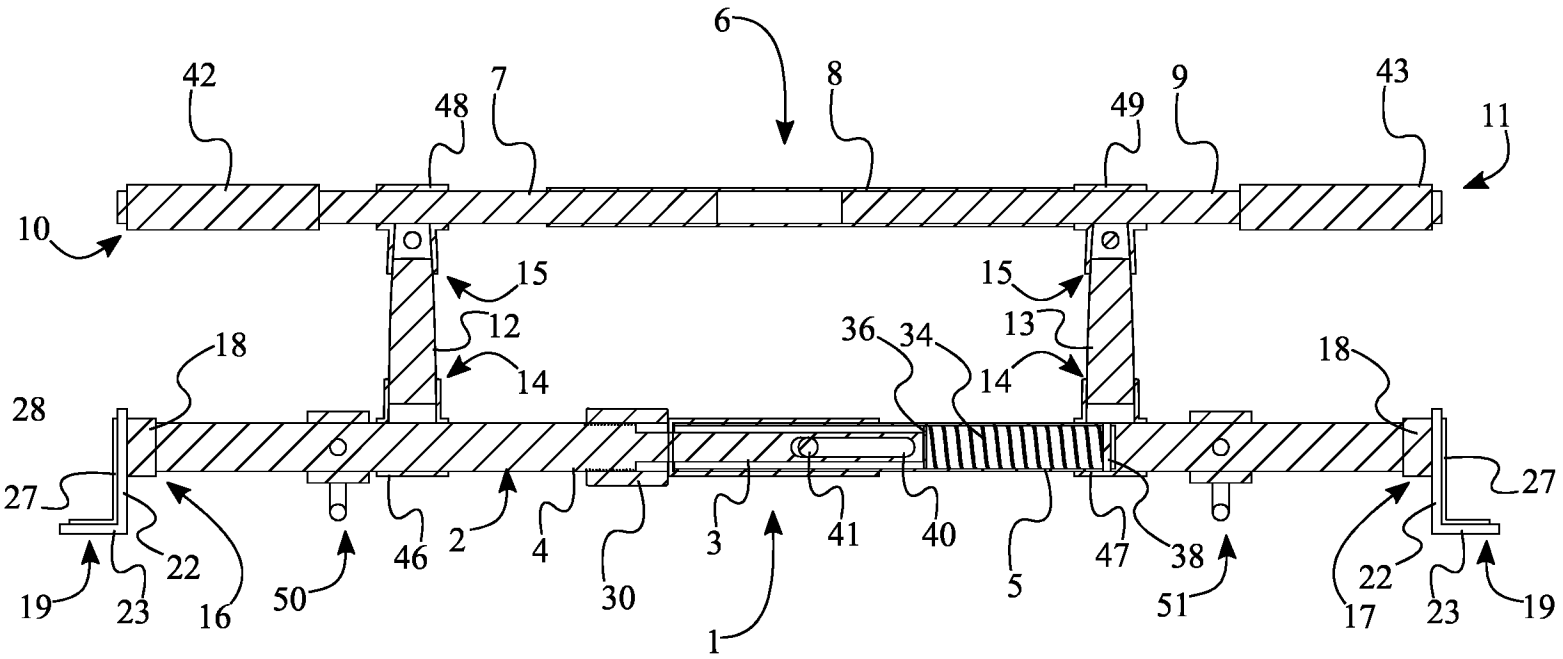
FIG. 6 is a cross-section view taken along line 6-6 in FIG. 5.

The locking mechanism 29 safely locks the total length while allowing a user to easily adjust the total length as the locking mechanism 29 may comprise a threaded coupler 30, a push sleeve 31, at least one pin-receiving hole 39, an elongated slot 40, and a connector pin 41, seen in FIG. 4 and FIG. 6. The threaded coupler 30 presses against the push sleeve 31 and secures the position of the push sleeve 31 along the right tube 5. The push sleeve 31 locks and unlocks the left tube 2 with the right tube 5. The at least one pin-receiving hole 39 allows the connecting pin to traverse through the right tube 5. The elongated slot 40 allows the connector pin 41 to slide along the inner portion 3 of the left tube 2. The connector pin 41 connects the left tube 2 within the right tube 5, specifically the inner portion 3 within the right tube 5. In order for the push sleeve 31 to wrap around the right tube 5, the push sleeve 31 may comprise a base plate 32 and a lateral wall 33. The base plate 32 serves as a stopper against the right tube 5, and the lateral wall 33 surrounds the corresponding end of the right tube 5. In order for the right tube 5 to be positioned within the push sleeve 31, the base plate 32 is positioned adjacent with the lateral wall 33, and the lateral wall 33 is perimetrically fixed around the base plate 32. The threaded coupler 30 is laterally positioned about the outer portion 4, adjacent to the inner portion 3, positioning the threaded coupler 30 against the push sleeve 31. The position of the threaded coupler 30 along the outer portion 4 is adjustable as the threaded coupler 30 is threadably engaged around the outer portion 4. In order to effectively press against the push sleeve 31, the base plate 32 is positioned adjacent with the threaded coupler 30. The connection between the left tube 2 and the right tube 5 is preserved as the inner portion 3 is slidably engaged through the base plate 32. The lateral wall 33 is slidably engaged around the right tube 5, allowing the push sleeve 31 to engage and disengage with the connector pin 41. The structural integrity of the right tube 5 is preserved as the at least one pin-receiving hole 39 laterally traverses through the right tube 5, offset from the base plate 32. This arrangement also allows the spring-loaded spring to extend and retract. The elongated slot 40 traverses through and along the inner portion 3, opposite to the outer portion 4, accommodating the linear movement of the inner portion 3 within the right tube 5. The at least one pin-receiving hole 39 and the elongated slot 40 is engaged by the connector pin 41, maintaining the connection between the left tube 2 within the right tube 5.

The stabilizing bar 1 is easily mounted within and removed from a door frame as the left tube 2 and right tube 5 pushes outwards against the door frame and may be compressed towards each other during removal. In order for the left tube 2 and the right tube 5 to exert a force against the door frame, the locking mechanism 29 may further comprise at least one spring 34, at least one washer 36, and a spacer 38, also seen in FIG. 4 and FIG. 6. The at least one spring 34 pushes the inner portion 3 of the left tube 2 away from the right tube 5, which consequently slides the connector pin 41 along the elongated slot 40. The at least one washer 36 stabilizes the at least one spring 34 within the right tube 5. The spacer 38 secures the position of the at least one spring 34 against the inner portion 3. The lateral wall 33 freely slides along the right tube 5 as the at least one spring 34, the at least one washer 36, and the spacer 38 are positioned within the right tube 5. The force of the at least one spring 34 against the inner portion 3 and is evenly distributed around the inner portion 3 as the at least one washer 36 is positioned adjacent with the inner portion 3, opposite the outer portion 4. The at least one spring 34 is positioned adjacent to the at least one washer 36, opposite the inner portion 3, thereby pushing the left tube 2 away from the right tube 3 and creating tension against the door frame. In order for the at least one spring 34 to constantly apply force against the inner portion 3 regardless of the position of the inner portion 3 within the right tube 5, the spacer 38 is positioned adjacent to the at least one spring 34, opposite the at least one washer 36 and is fixed within the right tube 5.

In order to secure position of the push sleeve 31 along the right tube 5, the push sleeve 31 may further comprise at least one first locking notch 56, at least one second locking notch 57, and a release slot 58, seen in FIG. 1, FIG. 2, FIG. 3, FIG. 4, FIG. 5, and FIG. 6. The at least one first locking notch 56 and the at least one second locking notch 57 allows both ends of the connector pin 41 that extend past the right tube 5 to latch into the lateral wall 33. While latched within the at least one first locking notch 56 and the at least one second locking notch 57, the push sleeve 31 is in a fully extended configuration. The release slot 58 allows the push sleeve 31 to retract from pressing against the threaded coupler 30, and consequently the outer portion 4 of the left tube 2. The at least one first locking notch 56, the at least one second locking notch 57, and the release slot 58 are laterally distributed around the lateral wall 33 and traverse into and along the lateral wall 33, opposite the base plate 32. This arrangement provides space for connector pin 41 to traverse into the lateral wall 33. More specifically, the release slot 58 is positioned in between the at least one first locking notch 56 and the at least one second locking notch 57, and the at least one first locking notch 56 and the at least one second locking notch 57 are colinear with each other. This arrangement accommodates the linear structure of the connector pin 41 through the right tube 5.

As the total length of the stabilizing bar 1 extends and retracts, the overall length of the main pullup bar 6 must simultaneously adjust. In order for the main pullup bar 6 to be length adjustable while maintaining the structural integrity of the main pullup bar 6, the main pullup bar 6 may comprise a left member 7, a central member 8, and a right member 9, seen in FIG. 1, FIG. 2, FIG. 3, FIG. 4, FIG. 5, and FIG. 6. The left member 7 extends past the first support bar 12, the right member 9 extends past the right support bar, and the central member 8 connects the right member 9 with the left member 7. In order for a user to grasp the main pullup bar 6, the left member 7 is oriented towards the left bracket assembly 16, and the right member 9 is oriented towards the right bracket assembly 17. The overall length of the main pullup bar 6 adjusts with the total length of the stabilizing bar 1 as the left member 7 is telescopically engaged into the central member 8, seen in FIG. 6. The right member 9 is fixed within the central member 8, opposite the left member 7, ensuring the safety and stability of the main pullup bar 6.

In the preferred embodiment of the present invention, the main pullup bar 6 further may comprise an elongated slot, a connector pin, and a pin-receiving hole similar to that of the push sleeve 31. The elongated slot of the main pullup bar 6 traverses through and along the left member 7, providing a path along the left member 7 for the connector pin to slide across. The pin-receiving hole laterally traverses through the central member 8, adjacent with the left member 7. This arrangement provides a path through the central member 8 for the connector pin and fixing the position of the connector pin along the central member 8. The left member 7 freely slides into and out of the central member 8 while remaining connected with the central member 8 as the elongated slot and the pin-receiving hole are both engaged by the connector pin.

In order for a user to comfortable grip the main pullup bar 6, the present invention may further comprise a first main handle grip 42 and a second main handle grip 43, seen in FIG. 1, FIG. 2, FIG. 3, and FIG. 5. Furthermore, the main pullup bar 6 may comprise a left end 10 and a right end 11. The left end 10 is oriented towards the left bracket assembly 16. The right end 11 is oriented towards the right bracket assembly 17. This arrangement allows the user to have a wide grip form while using the main pullup bar 6. The first main handle grip 42 is laterally mounted about the main pullup bar 6, adjacent to the left end 10, thereby cushioning the grip of the user along the left end 10. Similarly, the second main handle grip 43 is laterally mounted about the main pullup bar 6, adjacent to the right end 11, cushioning the grip of the user along the right end 11.

Similar to that of the main pullup bar 6, the present invention may further comprise a first support handle grip 44 and a second support handle grip 45 in order for the user to comfortably grip the left handlebar 25 and the right handlebar 26, seen in FIG. 1, FIG. 2, FIG. 3, and FIG. 5. More specifically, the first support bar 12 and the second support bar 13 may each comprise a proximal end 14 and a distal end 15. The proximal end 14 connects the left handlebar 25 and the right handlebar 26 with the stabilizing bar 1. The distal end 15 provides a user space to grasp the left handlebar 25 and the right handlebar 26. In order for the left handlebar 25 and the right handlebar 26 to extend from the stabilizing bar 1, the stabilizing bar 1 is terminally connected with the proximal end 14. The first support handle grip 44 is mounted around the distal end 15 of the left handlebar 25, thereby cushioning the grip of the user with the left handlebar 25. Similarly, the second support handle grip 45 is mounted around the distal end 15 of the right handlebar 26, cushioning the grip of the user with the right handlebar 26.

In order for the first support bar 12 and the second support bar 13 to be securely connected between the stabilizing bar 1 and the main pullup bar 6 while being positioned perpendicular to both the stabilizing bar 1 and the main pullup bar 6, the preferred embodiment of the present invention may further comprise a first proximal T-joint 46, a second proximal T-joint 47, a first distal T-joint 48, and a second distal T-joint 49. The first support bar 12 is securely connected between the stabilizing bar 1 and the main pullup bar 6 with the first proximal T-joint 46 and the first distal T-joint 48. The second support bar 13 is securely connected between the stabilizing bar 1 and the main pullup bar 6 with the second proximal T-joint 47 and the second distal T-joint 49. In order for the main pull up bar to rotate about the stabilizing bar 1, the first support bar 12 is rotatably mounted around the stabilizing bar 1 by the first proximal T-joint 46. Furthermore, the second support bar 13 is rotatably mounted around the stabilizing bar 1 by the second proximal T-joint 47. The main pullup bar 6 is secured to both the first support bar 12 and the second support bar 13 as the first support bar 12 is laterally mounted with the main pullup bar 6 by the first distal T-joint 48, and the second support bar 13 is laterally mounted with the main pullup bar 6 by the second distal T-joint 49.

The present invention allows a user to perform even more exercises as the present invention may further comprise a first hook 50 and a second hook 51. The first hook 50 and the second hook 51 serve as holders for tension bands and a variety of other exercise tools along the left handlebar 25 and the right handlebar 26. The first hook 50 and the second hook 51 each comprise a shank 52, which connects the first hook 50 and the second hook 51 with the left handlebar 25 and the second handlebar, respectively. More specifically, the first hook 50 is laterally mounted with the stabilizing bar 1, adjacent the left handlebar 25, and the second hook 51 is laterally mounted with the stabilizing bar 1, adjacent the right handlebar 26. In order for the first hook 50 to serve as an effective holder along the left handlebar 25, the shank 52 of the first hook 50 is positioned orthogonal to the stabilizing bar 1 and the left handlebar 25. Similarly, the second hook 51 serves as an effective holder along the right handlebar 26 as the shank 52 of the second hook 51 is positioned orthogonal to the stabilizing bar 1 and the right handlebar 26.

The present invention provides additional holders as the present invention may further comprise a third hook 53 and a fourth hook 54. The third hook 53 and the fourth hook 54 serve as holders for tension bands and a variety of other exercise tools along the main pullup bar 6. The third hook 53 and the fourth hook 54 may each comprise a shank 55, which connects the third hook 53 and the fourth hook 54 with the main pullup bar 6. More specifically, the third hook 53 is laterally mounted with the first support bar 12, adjacent to the main pullup bar 6, and the fourth hook 54 is laterally mounted with the second support bar 13, adjacent to the main pullup bar 6. This arrangement allows the user to grasp along the main pullup bar 6, uninhibited by the third hook 53 and the fourth hook 54. In order for the third hook 53 to serve as an effective holder along the left member 7, the shank 55 of the third hook 53 is positioned orthogonal to the main pullup bar 6 and the first support bar 12. Similarly, the fourth hook 54 serves as an effective holder along the right member 9 as the shank 55 of the fourth hook 54 is positioned orthogonal to the main pullup bar 6 and the second support bar 13.

Although the invention has been explained in relation to its preferred embodiment, it is to be understood that many other possible modifications and variations can be made without departing from the spirit and scope of the invention as hereinafter claimed.

What is claimed is:

1. A multi-functional doorway exercise device comprising:

a stabilizing bar;
a main pullup bar;
a first support bar;
a second support bar;
a left bracket assembly;
a right bracket assembly;
a left handlebar;
a right handlebar;
the left bracket assembly being terminally connected with the stabilizing bar;
the right bracket assembly being terminally connected with the stabilizing bar, opposite the left bracket assembly;
the main pullup bar being positioned parallel and offset from the stabilizing bar;
the first support bar and the second support bar being positioned in between the stabilizing bar and the main pullup bar;
the first support bar being positioned offset with the left bracket assembly;
the second support bar being positioned offset with the right bracket assembly;
the first support bar and the second support bar being positioned offset from each other;
the main pullup bar being rotatably mounted about the stabilizing bar by the first support bar and the second support bar;
the left handlebar being positioned in between the left bracket assembly and the first support bar;
the right handlebar being positioned in between the right bracket assembly and the second support bar;
the left handlebar and the right handlebar being fixed perpendicular with the stabilizing bar;
the left handlebar and the right handlebar being positioned parallel with each other;
a locking mechanism;
the stabilizing bar comprises a left tube and a right tube;

the left tube comprises an inner portion and an outer portion;

the right tube positioned adjacent with the left tube;

the right bracket assembly being terminally fixed with the right tube, opposite the left tube;

the inner portion being telescopically engaged into the right tube;

the outer portion being terminally fixed with the inner portion, opposite to the right tube;

the left bracket assembly being terminally fixed with the outer portion, opposite the inner portion;

the locking mechanism being operatively integrated in between the left tube and the right tube, wherein the locking mechanism is used to adjust a total length between the left tube and the right tube;

the locking mechanism comprising a threaded coupler, a push sleeve, at least one pin-receiving hole, an elongated slot, and a connector pin;

the push sleeve comprises a base plate and a lateral wall;

the base plate being positioned adjacent with the lateral wall;

the lateral wall being perimetrically fixed around the base plate;

the threaded coupler being laterally positioned about the outer portion, adjacent to the inner portion;

the threaded coupler being threadably engaged around the outer portion;

the base plate being positioned adjacent with the threaded coupler;

the inner portion being slidably engaged through the base plate;

the lateral wall being slidably engaged around the right tube;

the at least one pin-receiving hole laterally traversing through the right tube, offset from the base plate;

the elongated slot traversing through and along the inner portion, opposite to the outer portion; and, the at least one pin-receiving hole and the elongated slot being engaged by the connector pin.

2. The multi-functional doorway exercise device as claimed in claim 1 comprising:

the left bracket assembly and the right bracket assembly each comprise a connecting bar, a first L-shaped bracket, and a second L-shaped bracket;

each connecting bar being positioned perpendicular with the stabilizing bar;

the stabilizing bar being fixed adjacent with each connecting bar;

an outer surface of each second L-shaped bracket and an outer surface of each second L-shaped bracket being positioned adjacent with the respective connecting bar, opposite the stabilizing bar; and, each first L-shaped bracket being positioned opposite the respective second L-shaped bracket along the respective connecting bar.

3. The multi-functional doorway exercise device as claimed in claim 2 comprising:

each first L-shaped bracket and each second L-shaped bracket each comprise a proximal leg and a distal leg;

each proximal leg being positioned orthogonal to the respective connecting bar and the stabilizing bar;

each proximal leg being laterally fixed with the respective connecting bar; and, the distal leg of each first L-shaped bracket and the distal leg of each second L-shaped bracket being oriented away from the respective connecting bar.

4. The multi-functional doorway exercise device as claimed in claim 2 comprising:

a first padded layer;

a second padded layer;

the first padded layer being fixed across an inner surface of each first L-shaped bracket; and, the second padded layer being fixed across an inner surface of each second L-shaped bracket.

5. The multi-functional doorway exercise device as claimed in claim 1 comprising:

a first hook;

a second hook;

the first hook and the second hook each comprising a shank;

the first hook being laterally mounted with the stabilizing bar, adjacent the left handlebar;

the second hook being laterally mounted with the stabilizing bar, adjacent the right handlebar;

the shank of the first hook being positioned orthogonal to the stabilizing bar and the left handlebar; and, the shank of the second hook being positioned orthogonal to the stabilizing bar and the right handlebar.

6. The multi-functional doorway exercise device as claimed in claim 5 comprising:

a third hook;

a fourth hook;

the third hook and the fourth hook each comprising a shank;

the third hook being laterally mounted with the first support bar, adjacent to the main pullup bar;

the fourth hook being laterally mounted with the second support bar, adjacent to the main pullup bar;

the shank of the third hook being positioned orthogonal to the main pullup bar and the first support bar; and, the shank of the fourth hook being positioned orthogonal to the main pullup bar and the second support bar.

7. The multi-functional doorway exercise device as claimed in claim 1 comprising:

the locking mechanism further comprises at least one spring, at least one washer, and at least one spacer;

the at least one spring, the at least one washer, and the at least one spacer being positioned within the right tube;

the at least one washer being positioned adjacent with the inner portion, opposite the outer portion;

the at least one spring being positioned adjacent to the at least one washer, opposite the inner portion;

the at least one spacer being positioned adjacent to the at least one spring, opposite the at least one washer;

the at least one spacer being fixed within the right tube.

8. The multi-functional doorway exercise device as claimed in claim 1 comprising:

the push sleeve further comprising at least one first locking notch, at least one second locking notch, and a release slot;

the at least one first locking notch, the at least one second locking notch, and the release slot being laterally distributed around the lateral wall;

the at least one first locking notch, the at least one second locking notch, and the release slot traversing into and along the lateral wall, opposite the base plate.

9. The multi-functional doorway exercise device as claimed in claim 1 comprising:

the main pullup bar comprises a left member, a central member, and a right member;

the left member being oriented towards the left bracket assembly;

the right member being oriented towards the right bracket assembly;

the left member being telescopically engaged into the central member; and, the right member being fixed within the central member, opposite the left member.

10. The multi-functional doorway exercise device as claimed in claim 1 comprising:

a first main handle grip;

a second main handle grip;

the main pullup bar comprising a left end and a right end;

the left end being oriented towards the left bracket assembly;

the right end being oriented towards the right bracket assembly;

the first main handle grip being laterally mounted about the main pullup bar, adjacent to the left end; and, the second main handle grip being laterally mounted about the main pullup bar, adjacent to the right end.

11. The multi-functional doorway exercise device as claimed in claim 1 comprising:

a first support handle grip;

a second support handle grip;

the first support bar and the second support bar each comprising a proximal end and a distal end;

the stabilizing bar being terminally connected with the proximal end;

the left handlebar comprising a proximal and a distal end the first support handle grip being mounted around the distal end of the left handlebar;

the right handlebar comprising a proximal and a distal end; and the second support handle grip being mounted around the distal end of the right handlebar.

12. The multi-functional doorway exercise device as claimed in claim 1 comprising:

a first proximal T-joint;

a second proximal T-joint;

a first distal T-joint;

a second distal T-joint;

the first support bar being rotatably mounted around the stabilizing bar by the first proximal T-joint;

the second support bar being rotatably mounted around the stabilizing bar by the second proximal T-joint;

the first support bar being laterally mounted with the main pullup bar by the first distal T-joint; and, the second support bar being laterally mounted with the main pullup bar by the second distal T-joint.

* * * * *